United States Patent [19]

Walter

[11] 4,065,762

[45] Dec. 27, 1977

[54] A.C. BRIDGE INTRUSION ALARM SYSTEM

[76] Inventor: John W. Walter, 511 Manhasset Woods Road, Manhasset, N.Y. 11030

[21] Appl. No.: 644,401

[22] Filed: Dec. 29, 1975

[51] Int. Cl.[2] ..... G08B 13/02

[52] U.S. Cl. ..... 340/285; 340/276; 340/274 R

[58] Field of Search ..... 340/276, 274, 285; 323/75 E

[56] References Cited

U.S. PATENT DOCUMENTS

| | | | |
|---|---|---|---|
| 3,544,984 | 12/1970 | Hanson | 340/285 X |
| 3,609,739 | 9/1971 | Walter | 340/285 X |
| 3,624,646 | 11/1971 | Weiss | 340/285 X |

*Primary Examiner*—Glen R. Swann, III
*Attorney, Agent, or Firm*—Allison C. Collard

[57] ABSTRACT

An AC alarm system for protection against unauthorized intrusion having an alarm which consists of two pairs of adjacent bridge arms, each having at least one fixed resistor and a normally open switch shunted across at least one of the fixed resistors. The switches are normally open in a safety condition of the system and adapted to be closed during an unsafe condition. A variable resistor is also connected in series with one or more of the fixed resistors for balancing the bridge circuit. An AC transformer is provided having a secondary winding connected to opposite points of the bridge arms and two detection latch circuits are each connected at another of opposite points of the bridge arms for detecting a change in the resistance values of pairs of bridge arms and for producing a current in response to that change in order to actuate an alarm.

4 Claims, 2 Drawing Figures

A.C. BRIDGE INTRUSION ALARM SYSTEM

BACKGROUND OF THE INVENTION

This invention relates to an improved alarm system for providing an alarm in response to the intrusion of at least one or a plurality of protective stations.

More specifically, this invention relates to an improved electronic burglar alarm system having a plurality of impedance branches which are connected to the legs of an electrical bridge circuit so that one or more of the legs can be made responsive to a varying condition resulting from the attempted intrusion at a protected station so as to change the impedance of that leg and to provide a visual or audible alarm.

In conventional burglar alarm systems, stations to be protected such as windows and doors of a building are wired in series connection to an electrical alarm system. A constant DC current is then applied to the wire and is used to hold a latching relay into an actuated position so that if an intrusion is made at any of the stations, the current will be momentarily interrupted so as to trip the latch relay and actuate the alarm system. Generally, the reconnection of the current at the station where the intrusion took place will not cause the latch relay to disconnect the alarm until a manual reset or timing switch turns the alarm system off. These conventional burglar alarm systems suffer from the disadvantage that persons familiar with the system can short circuit one or more of the stations and therefore bypass the alarm system to gain an intrusion into a building or home. The short circuiting of these conventional systems is generally performed by persons within the building structure such as employees, in order to gain illegal access to the building at a later time.

In order to overcome the disadvantages of these conventional systems, the applicant designed a DC impedance system so that each of the stations will operate at a predetermined impedance which is connected to a DC electrical bridge circuit. As soon as all of the stations are connected to the electrical bridge circuit, the bridge circuit can then be balanced so that the disturbance of any one station will upset the bridge and cause an audible or visual alarm to be actuated. Thus, anyone attempting to short circuit a station will immediately unbalance the bridge circuit and cause an alarm to be actuated. Such a system is shown in applicant's U.S. Pat. No. 3,609,739 which issued on Sept. 28, 1971.

With the ready accessability of more sophisticated equipment, burglars have been able to use electrical measuring instruments to determine the DC voltage connected across a door or station impedance, and attempt to circumvent the station impedance by using an electrical battery source having a potentiometer, so as to produce variable DC voltage. Thus, the voltage appearing across the impedance of a particular station can be measured and duplicated so as to bypass the system. Such an alteration of the system would generally take place when a building or office is unoccupied and the potential burglars have had an opportunity to gain partial access to the system and to a particular station and to measure the voltage across the impedance of that station.

SUMMARY OF THE INVENTION

In order to overcome this disadvantage of the applicant's patented system No. 3,609,739, applicant has provided an improved and novel alternating current bridge circuit wherein one or more legs of the bridge includes an impedance which is connected to a particular station. Thus with an AC voltage appearing across the impedance of any one station, it is extremely difficult to bypass the station by providing an identical AC voltage which matches both in magnitude and phase, to the impedance of the station. Thus, in order to match the impedances of the AC bridge network, a potential burglar would have to have access to an AC voltage source, a variable transformer to adjust the potential of that source, and a phase meter in order to match the phase of the impedance with the external power source. For a potential burglar operating on the outside of a building, the availability of an AC power source is remote so that the chances of bypassing stations which are coupled to an AC bridge system becomes extremely unlikely.

It is therefore an object according to the present invention to provide an improved burglar alarm system using an AC bridge circuit having one or more legs containing impedances for connection to one or a plurality of protective stations.

It is another object according to the present invention to provide an improved burglar alarm system using an AC bridge circuit having controlled impedances which is simple in design, easy to manufacture and reliable in operation.

Other objects and features of the present invention will become apparent from the following detailed description considered in connection with the accompanying drawings which disclose the embodiments of the invention. It is to be understood however that the drawings are designed for the purposes of illustration only and not as a definition of the limits of the invention.

BRIEF DESCRIPTION OF THE DRAWING

In the drawings, wherein similar reference characters denote similar elements throughout the two views.

DESCRIPTION OF THE PREFERRED EMBODIMENT

Figure 1:
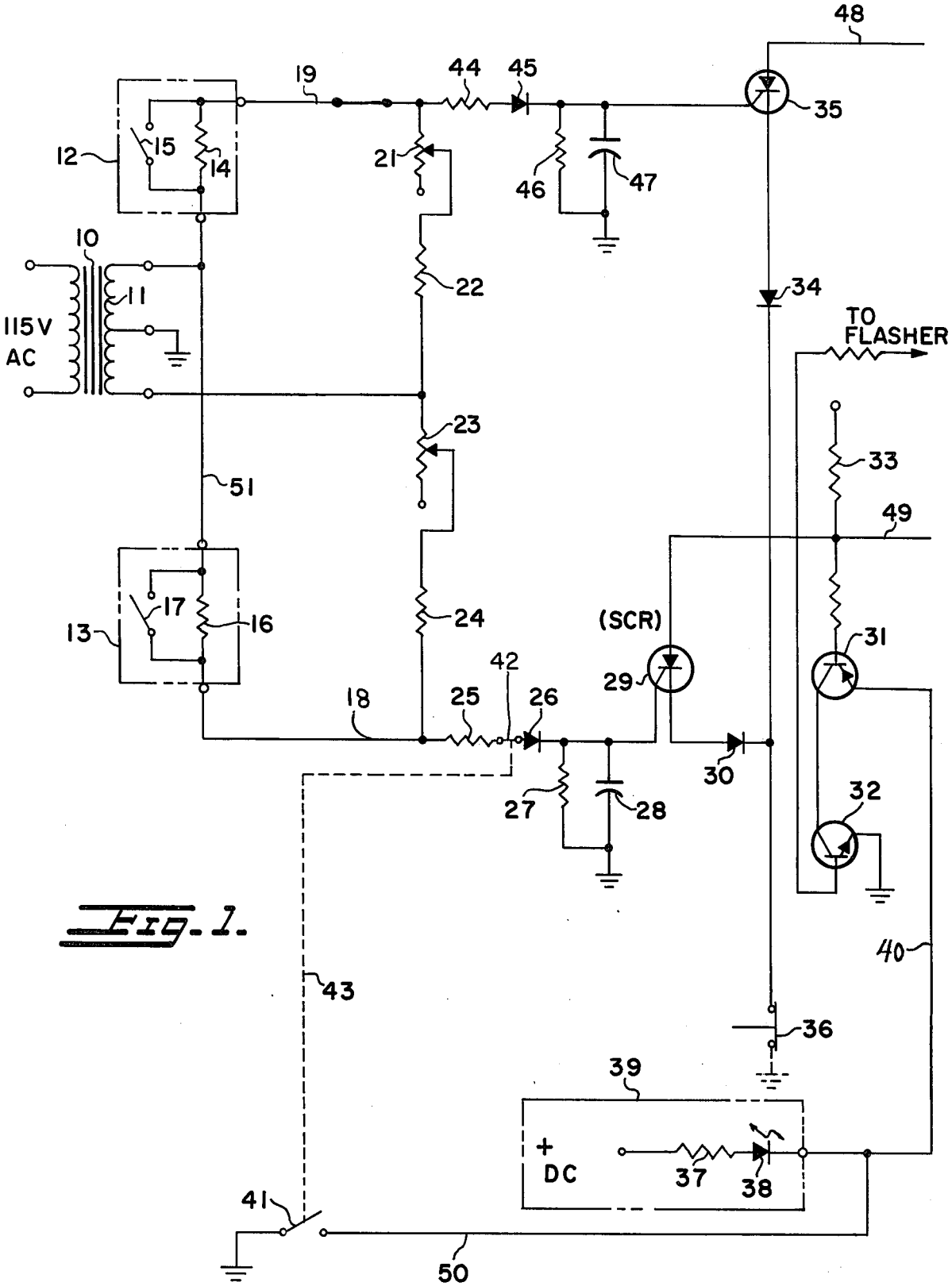
FIG. 1 is an electrical schematic diagram showing in detail the AC bridge circuit having four branches, with two impedance measuring branches connected to a protective station.

Referring to FIG. 1, there is shown an electrical transformer 10 which could be connected to a conventional power source such as 110 volts AC, or could be connected to an AC generator producing a frequency above or below the standard 60 cycles supplied by the utility company, and having a secondary winding 11 which is connected to opposite points of an electrical bridge circuit. The center tap of the secondary winding is preferably grounded, and one electrical terminal is connected between impedance branches 12 and 13, which include at least one resistance element 14 and 16, respectively, hidden (as indicated by the dashed line) in a switch 15 and 17, respectively. Connected across each of the resistance elements are the electrical switches 15 and 17, respectively, which are in a normally open position when a protected station such as a door or window is in a closed position. When there is an attempted intrusion at a particular station, switch 15 or 17 will close to change the impedance of the particular branch of the bridge.

Branches 12 and 15 are connected through conductors 19 and 18 to branches consisting of variable resistors 21 and 23 and fixed resistors 22 and 24. Fixed resistor 22 is chosen to be slightly less than the resistance value of resistor 14, so that it can be adjusted to match resistance 14 added to the resistance of the connecting wires 19 and 51 by means of changing the resistance of potentiometer 21. Likewise, potentiometer 23 can be used to compensate for the resistance of resistor 16 and connecting wires 18 and 51 so that the bridge can be balanced for both the impedances of branches 12 and 13. In this particular embodiment, only two branches 12 and 13 are shown being utilized to protect stations. However, all four branches could be used to protect a plurality of stations whereby all of the branches would be balanced with each other so that the bridge circuit would remain balanced until an intrusion is made to any one station.

The AC bridge of the present invention has two outputs which measure the balance of the bridge with respect to ground potential. The first output taken from the intersection of branch 12, and the resistance combination of resistors 21 and 22 is coupled through resistor 44, through diode 45 to a detection latch circuit 35 consisting of an SCR (silicon controlled rectifier). Likewise, the second output of the bridge is taken from the intersection of branches 13, and resistors 23 and 24, and is coupled through resistor 25 and diode 26 to a second detection latch consisting of SCR 29. Suitable biasing resistors 27 and 46 and stabilizing capacitors 28 and 47 are connected to the input triggers of SCRs 29 and 35 as is well known in the art. The output of SCR 29 is coupled to the input of a lamp driver circuit consisting of transistors 31 and 32 connected as amplifiers so as to provide an output through conductor 40 to a light emitting diode display consisting of light emitting diode (LED) 38 connected through resistor 37 to a DC power source. In a similar manner (not shown), the output 48 of detection latch circuit 35 is connected through amplifiers to a light emitting diode display. The cathodes of SCRs 35 and 29 are connected through diodes 34 and 30 to ground potential through switch 36. SCRs 29 and 35 can be reset to their unlatched mode by momentarily opening switch 36, after the input is reduced from the triggers.

Figure 2:
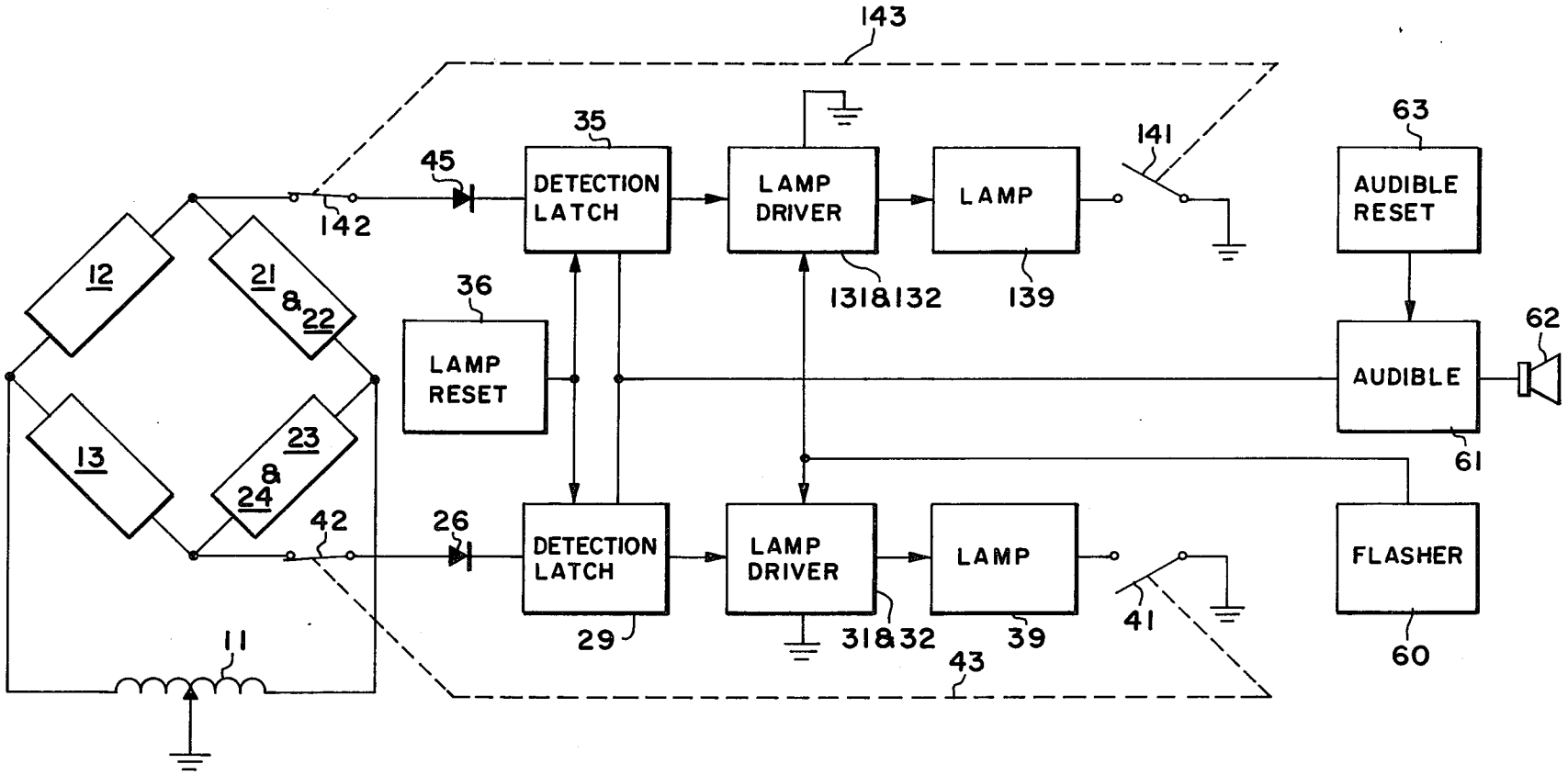
FIG. 2 is an electrical block diagram which includes a portion of the schematic diagram of FIG. 1 together with the description of the complete system of the invention.

FIG. 2 discloses an electrical block diagram of the bridge circuit of FIG. 1 together with an alarm system connected to the bridge circuit. The bridge circuit is connected through switches 42 and 142 through diodes 26 and 45 to detection latch circuits 35 and 29. The output from each of the detection latches are connected to lamp driver amplifiers 131-132 and 31 and 32 as discussed previously with respect to the embodiment of FIG. 1. The output of each lamp driver amplifier is connected to a lamp and the lamps in turn are connected in series with switches 141 and 41. Switches 41 and 42 and 141 and 142 are ganged by means of a single mechanical throw 43 and 143 so that the bridge circuit can be disconnected from the alarm system and the lamps will light in a steady condition indicating such disconnection. Each of the outputs of the detection latches are also connected to an audible alam circuit 61 which has its output connected to a sounding device 62. The audible alarm system includes a reset circuit 63. A flasher circuit 60 is connected to each of the lamp drivers so as to flash the lamps 39 or 139 when they are energized by an unbalance in the bridge.

In operation, after the branches of the bridge circuits are balanced so that no potential appears at the input of latch detectors 29 and 35, there will be no output signal provided to the lamp driver circuits so that lamps 139 or 39 will not be lit. Moreover, no signal will be provided to the audible alarm 161 so that the alarm will remain silent.

If switch 17 is closed to simulate an intruder entering a particular station having branch 13 protecting that station, half of the bridge circuit will be unbalanced so that an AC potential will appear at resistor 25 and be coupled through diode 26 to trigger SCR 29. The value of capacitor 28 can be set so that unbalance would have to exist for a finite time such as one half second or more before SCR 29 is triggered. Lamp driver 31, 32 will then turn on light emitting diode 38 to signal on a control panel that an intrusion has been made on branch 13. The output of SCR 29 is also connected to audible alarm 61 so that the alarm will actuate a power load speaker 62. Flashing unit 60, an optional feature, can be used to cause lamp 39 to flash intermittently on a control panel by causing transistor 12 to turn on and off.

In a simmilar manner, if switch 15 of a protected station is closed to unbalance the upper portion of the bridge, an input signal will be produced on the trigger of detection latch 35 to also light lamp 39 and operate audible alarm 61.

To reset either the upper or lower portions of the bridge, ganged switch 143 or 43 is used to disconnect the bridge and the lamp circuits from the alarm system. After each of the stations are properly closed so that switches 15 and 17 are open, switches 43 and 143 can then be closed to monitor branches 12 and 13 of the bridge circuit.

In the bridge circuit of the present invention, the secondary of transformer 10 preferably has a 24-volt center tapped output and resistors 14 and 16 are preferably set at 5.1 K ohms. Fixed resistors 22 and 24 are preferably 4.7 K ohms and potentiometers 21 and 34 are preferably 1000 ohms each. The impedance of the bridge is maintained approximately 5000 ohms for each branch of the bridge and the bridge has a tolerance for sensitivity of plus or minus 10% for the impedance of any one branch before the alarm sounds. While two branches 12 and 13 are shown for protecting remote stations, it is also obvious that the remaining two branches could also be utilized to protect stations so that all of the branches could be balanced against each other in the alarm circuit.

While only a few embodiments of the present invention have been shown and described, it will be obvious that many changes and modifications may be made thereunto without departing from the spirit and scope of the invention.

What is claimed is:

1. An alternating current alarm system for the protection against unauthorized intrusion having an alarm, comprising:

two adjacent bridge arms, each arm having at least one fixed resistor constituting a sensing resistor, and at least one variable resistor in series with the fixed resistor, constituting a balancing resistor, the combination constituting a rectangular connected electrical bridge circuit;

normally open switch means shunted across at least one of said fixed resistors, said switch means being open in a safe condition of the system and adapted to be closed during an unsafe condition thereof;

an alternating circuit transformer having a secondary winding connected to opposite points of said bridge arms of said bridge circuit, said secondary having a center tap winding connected to a common ground of the system, and at least one diode connected to the intersection of each variable and fixed resistor in each bridge arm, a pair of detection latch means each connected to the output of said diodes for detecting a change in the resistance value of said bridge arms and for producing a current in response to said change which actuates said alarm.

2. The alarm system as recited in claim 1 wherein said detection latch means comprises a silicon controlled rectifier including an input trigger and a parallel arrangement of a biasing resistor and stabilizing capacitor connected to said input trigger.

3. The alarm system as recited in claim 1, further comprising a lamp driver circuit connected to each of said detection latch means, and a light emitting diode connected to said lamp driver circuit and actuated by the latter upon the production of said current by said detection latch means.

4. The alarm system as recited in claim 1, wherein said at least one of said fixed resistors is hidden in said normally open switch means.

* * * * *